US008601773B2

(12) United States Patent
Cadieux, Jr. et al.

(10) Patent No.: US 8,601,773 B2
(45) Date of Patent: Dec. 10, 2013

(54) IN-LINE INSERT FOLDER SYSTEM

(75) Inventors: Edmond J. Cadieux, Jr., Midlothian, VA (US); Barry S. Smith, Hopewell, VA (US); Robert G. Scott, Midlothian, VA (US); Martin T. Garthaffner, Chesterfield, VA (US); Steve R. Rinehart, Chesterfield, VA (US); Xuan Pham, Richmond, VA (US); Linwood H. Carneal, Jr., Richmond, VA (US); Hubert Coleman Goodman, Jr., Richmond, VA (US); Joshua L. Roby, Mechanicsville, VA (US); Christopher Crawford, Petersburg, VA (US); James D. Evans, Chesterfield, VA (US)

(73) Assignee: Philip Morris USA Inc., Richmond, VA (US)

( * ) Notice: Subject to any disclaimer, the term of this patent is extended or adjusted under 35 U.S.C. 154(b) by 937 days.

(21) Appl. No.: 10/447,063

(22) Filed: May 28, 2003

(65) Prior Publication Data

US 2004/0000125 A1 Jan. 1, 2004

Related U.S. Application Data

(60) Provisional application No. 60/392,173, filed on Jun. 27, 2002.

(51) Int. Cl.
*B65B 61/20* (2006.01)

(52) U.S. Cl.
USPC ..... 53/415; 53/135.3; 53/136.1; 493/420

(58) Field of Classification Search
USPC ..... 53/415, 474, 445, 238, 237, 135.1, 53/135.3, 136.1, 45; 493/419–421
See application file for complete search history.

(56) References Cited

U.S. PATENT DOCUMENTS

| | | | | | |
|---|---|---|---|---|---|
| 1,818,923 | A | * | 8/1931 | Taylor | 53/449 |
| 1,913,642 | A | * | 6/1933 | Smith | 53/494 |
| 2,011,399 | A | * | 8/1935 | Driscoll | 206/237 |
| 3,089,695 | A | * | 5/1963 | Brooks | 493/419 |
| 3,695,422 | A | * | 10/1972 | Tripodi | 206/232 |
| 3,897,293 | A | * | 7/1975 | Babcock | 156/227 |
| 4,125,254 | A | | 11/1978 | Boyer | |
| 4,225,128 | A | * | 9/1980 | Holyoke | 493/421 |
| 4,351,679 | A | * | 9/1982 | Dreher | 156/70 |
| 4,502,910 | A | | 3/1985 | Voltmer et al. | |

(Continued)

FOREIGN PATENT DOCUMENTS

| | | | |
|---|---|---|---|
| CN | 1077065 | C | 1/2002 |
| EP | 0274872 | A2 | 7/1988 |

(Continued)

*Primary Examiner* — Stephen F Gerrity
(74) *Attorney, Agent, or Firm* — Roberts Mlotkowski Safran & Cole, P.C.

(57) ABSTRACT

An in-line insert folder system includes a continuous roll of preprinted inserts, and a cutter for cutting individual inserts from the roll. A transport serially conveys the individual inserts in a downstream direction to a buckle folder that receives the inserts and folds each one along at least one fold line. An applicator serially receives the folded inserts from the buckle folder and applies the inserts to consumer packs such as cigarette packs, for example. The folded inserts may be directly applied to the packs before placement of flexible outer wrap or the folded inserts may be applied onto the flexible outer wrap before that wrap is placed around the packs.

14 Claims, 3 Drawing Sheets

(56) References Cited

U.S. PATENT DOCUMENTS

| | | | | |
|---|---|---|---|---|
| 4,605,459 | A * | 8/1986 | Voltmer et al. | 156/215 |
| 4,655,871 | A * | 4/1987 | Mattei et al. | 156/484 |
| 5,035,935 | A | 7/1991 | Thomas et al. | |
| 5,044,873 | A * | 9/1991 | Vijuk | 414/792.5 |
| 5,111,633 | A * | 5/1992 | Draghetti | 53/136.1 |
| 5,242,364 | A * | 9/1993 | Lehmann | 493/8 |
| 5,607,526 | A * | 3/1997 | Buckley | 156/64 |
| 5,640,831 | A | 6/1997 | Harrod et al. | |
| 5,972,153 | A | 10/1999 | Focke et al. | |
| 5,983,600 | A * | 11/1999 | Heide et al. | 53/415 |
| 6,036,006 | A * | 3/2000 | Focke | 206/264 |
| 6,105,340 | A * | 8/2000 | Draghetti | 53/415 |
| 6,216,860 | B1 * | 4/2001 | Boriani et al. | 206/268 |
| 6,224,560 | B1 | 5/2001 | Gazula et al. | |
| 6,401,918 | B1 * | 6/2002 | Focke et al. | 206/268 |
| 6,438,927 | B1 * | 8/2002 | Focke et al. | 53/415 |
| 6,467,614 | B1 * | 10/2002 | Tallier et al. | 206/264 |
| 6,475,129 | B1 * | 11/2002 | Lehmann | 493/421 |
| 6,615,980 | B2 * | 9/2003 | Draghetti et al. | 206/245 |
| 6,669,015 | B2 * | 12/2003 | Draghetti et al. | 206/271 |
| 2002/0185232 | A1 * | 12/2002 | Draghetti et al. | 156/543 |

FOREIGN PATENT DOCUMENTS

| | | |
|---|---|---|
| SU | 410966 | 1/1974 |
| SU | 1735131 | 5/1992 |
| WO | WO-01/60715 A2 | 8/2001 |

* cited by examiner

IN-LINE INSERT FOLDER SYSTEM

BACKGROUND OF THE INVENTION

The present invention relates to an in-line insert folder system for folding printed inserts and serially delivering them to an applicator for placement directly onto consumer packs, such as cigarette packs, or onto the outer wrap for the packs prior to placement around the packs.

Particularly in the case of cigarette packs, there is an increasing need for the packs to include printed inserts containing information about the cigarettes and/or serving as a medium for advertising purposes. In other instances, such inserts may take the form of a coupon providing eligibility for the consumer to participate in prize drawings and the like. In the case of cigarette packs which are usually provided with an outer wrap of transparent film, printed inserts may be positioned between the pack and the outer wrap whereby the insert can be seen from the outside when the pack and outer wrap are still intact. When positioned between the pack and outer wrap the insert may be placed directly onto the pack and subsequently wrapped, or the insert may be initially placed onto the flexible outer wrap before the pack is wrapped with such material.

Currently many inserts are pre-folded and delivered to cigarette packs via stacks of individual pre-folded inserts. Disadvantages of this approach involve the overall expense and difficulty of making pre-folded bobbins or stacks of individual printed insert material. Moreover, individual inserts are difficult to handle at cigarette packaging machines that operate at extremely high production speeds in that the inserts tend to jam quite easily, and therefore require intensive operator intervention for feeding them to applicators that deliver and apply the inserts to the cigarette packs.

SUMMARY OF THE INVENTION

Accordingly, one of the objects of the present invention is an in-line insert folder system that includes a continuous roll of unfolded printed inserts with a cutter head that cuts individual inserts from the continuous roll, and a buckle folder for folding the individual inserts and delivering them to an applicator for placement directly onto consumer packs such cigarette packs or onto the outer film wrap for the packs.

Another object of the present invention is an in-line insert folder system that includes a buckle folder with cantilevered rollers that function to inherently remove from the open side of the rollers those inserts that become misaligned during the high speed folding process.

In accordance with the present invention, an in-line insert folder system comprises a continuous roll of preprinted inserts, and a cutter constructed and arranged to cut individual inserts from the roll. A transport mechanism serially conveys the individual inserts in flat unfolded form in a downstream direction to a buckle folder that receives each insert and folds the insert along at least one fold line. An applicator serially receives the folded inserts from the buckle folder and directly applies them to consumer packs or the outer wrap for the packs.

Preferably, the buckle folder includes a plurality of rollers having horizontal axes of rotation generally parallel to one another. The rollers are mounted to a vertical framework in cantilever fashion. This orientation has the advantage of making the buckle folder self clearing in that inserts that become misaligned during the high speed folding process are ejected from the buckle folder through the open outer side of the rollers.

In one embodiment of the present invention the applicator is adjacent a stream of spaced apart consumer packs, and the applicator applies the folded inserts directly onto the packs before the placement of flexible outer wrap around the packs.

In another embodiment of the present invention the applicator applies the folded inserts directly onto flexible outer wrap material before that material is placed around the packs. In either embodiment adhesive may be applied to the folded inserts prior to application of the inserts to the consumer packs or flexible outer wrap material.

The present invention is also directed to a method of folding preprinted inserts and applying the folded inserts to consumer packs. The method includes the steps of providing a continuous roll of preprinted inserts and cutting individual inserts from the roll. The cut individual inserts are serially conveyed in a downstream direction and subsequently folded along at least one fold line. The folded inserts are then applied to the consumer packs either directly before the placement of flexible outer wrap or alternatively to the flexible outer wrap before placement around the packs.

BRIEF DESCRIPTION OF THE DRAWINGS

Novel features and advantages of the present invention in addition to those mentioned above will become apparent to persons of ordinary skill in the art from a reading of the following detailed description in conjunction with the accompanying drawings wherein similar reference characters refer to similar parts and in which.

DETAILED DESCRIPTION OF THE INVENTION

Figures 1, 3:
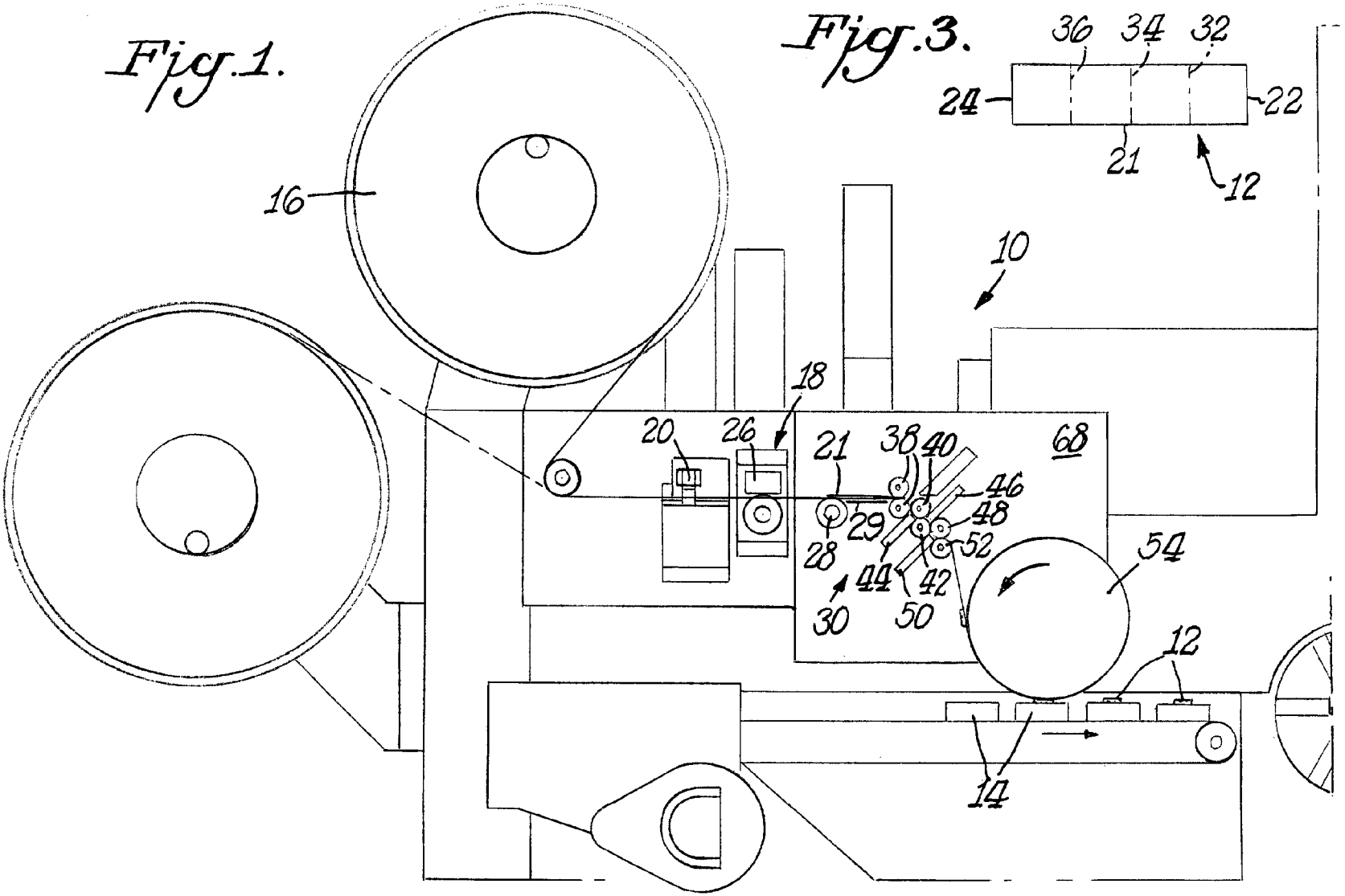
FIG. 1 is a diagrammatic front elevational view of an in-line insert folder system for producing folded inserts and applying them directly onto consumer packs such as cigarette packs.
FIG. 3 is a top plan view of an individual preprinted insert prior to being folded but showing the subsequently produced fold lines.

Referring in more particularity to the drawings, FIG. 1 illustrates an in-line insert folder system 10 for producing folded inserts 12 and applying them directly onto consumer packs such as cigarette packs 14. The fundamental components of system 10 preferably include a continuous roll 16 of preprinted inserts together with a cutter assembly 18 which operates to cut individual inserts 21 from the continuous roll. A sensing arrangement 20 functions to determine the forward and trailing boundaries 22, 24, respectively, of the inserts in order to properly control a cutting head 26 of assembly 18 when individual inserts are cut from the roll.

A transport 28 downstream from the cutter assembly serially conveys the individual inserts in a downstream direction to a buckle folder 30 which receives the individual inserts and folds each insert along predetermined fold lines 32, 34 and 36. Transport 28 may comprise a rotating vacuum drum with a downstream plate 29 between the drum and the entrance to the buckle folder. The rotating vacuum drum functions to push insert 21 in a downstream direction to the buckle folder.

Buckle folders generally function to produce folds in paper goods by stopping the forward end of a paper substrate while continuing to move the remainder of the substrate thereby causing it to buckle downwardly into a roller nip which produces the fold. Mechanisms of this general type are described in U.S. Pat. Nos. 4,125,254 ad 6,224,560, both of which are incorporated herein by reference for all useful purposes. Fundamentally, buckle folder 30 includes a pair of rollers 38 at the entrance of the folder for receiving an individual printed insert 21 and delivering that insert through the folder. Immediately after passing through the nip of entrance rollers 38 the insert is fed between roller pair 38, 40 until the forward boundary 22 of the insert strikes a stop in first fold pan or chute 44. The insert then buckles downwardly into the nip of a first roller pair 40, 42, and the first fold 32 is imparted to the printed insert. The insert is then fed and bucked in seriatim into a second fold pan or chute 46 and then through a second roller pair comprising roller 42 and roller 48 which produces the second fold line 34. Next the partially folded insert enters a third pan or chute 50, buckles downwardly and passes through a third roller pair comprising roller 48 and roller 52.

Upon exiting the buckle folder, the folded insert is delivered to an applicator 54 in the form of a drum, and the applicator applies the folded inserts directly onto a stream of spaced apart cigarette packs 14. Adhesive may be applied to the inserts to secure them to the outside of the cigarette packs. Subsequently, the cigarette packs with the inserts secured thereto are wrapped with a flexible outer wrap material, as is well known.

Figure 2:
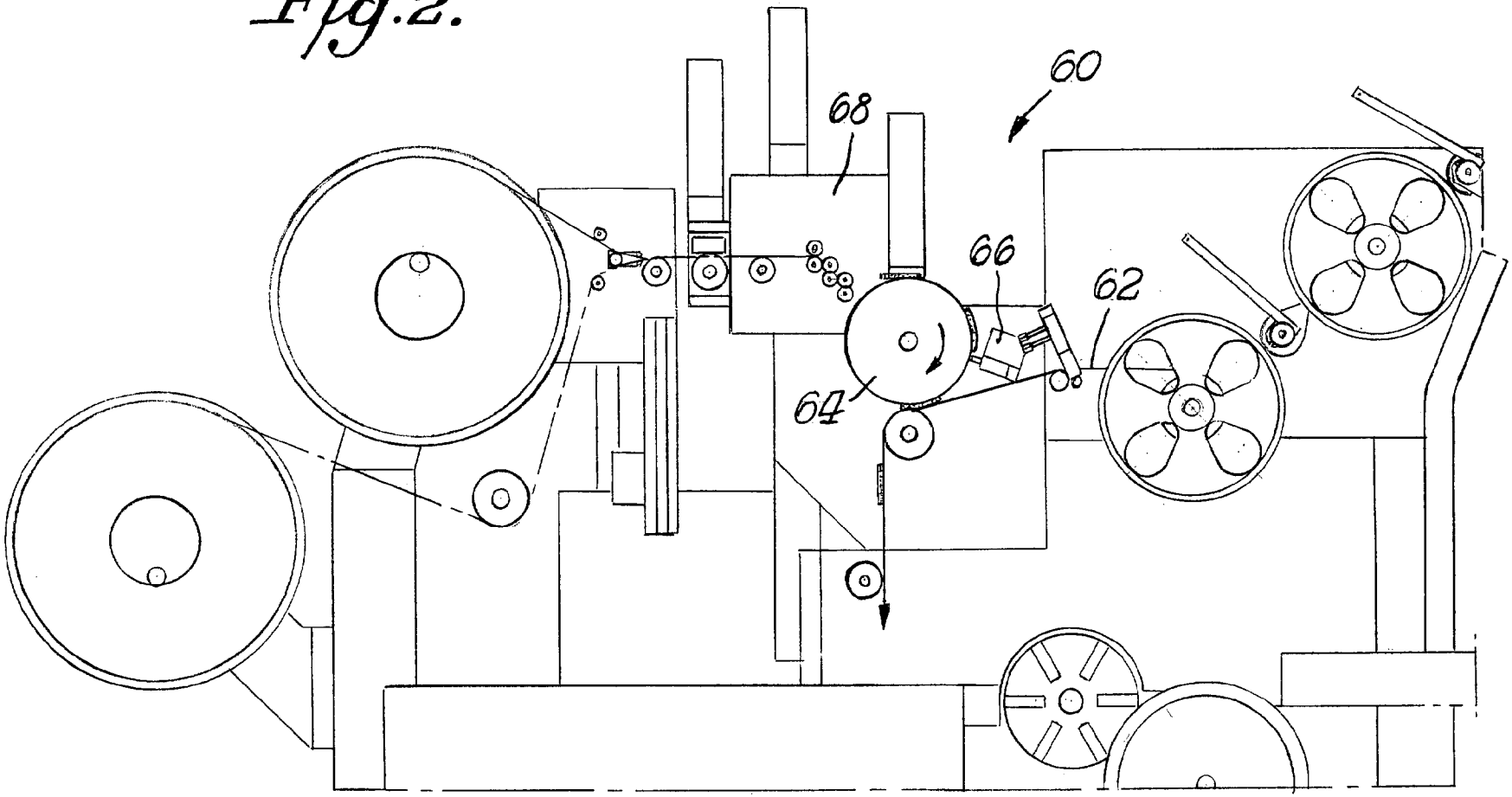
FIG. 2 is a diagrammatic view of another in-line insert folder system for producing folded inserts and applying them to flexible film outer wrap material prior to wrapping consumer packs such as cigarettes with the material.

FIG. 2 shows another in-line insert folder system for producing folded inserts 12 and applying them to flexible film outer wrap material 62 prior to wrapping the cigarette packs 14 with such material. Basically the system 60 is the same as system 10 shown in FIG. 1 with respect to the components thereof for producing the folded inserts 12. However, in system 60 the folded inserts are delivered to an applicator 64 in the form of a drum that receives the folded inserts and applies those inserts to the outer wrap material 62 for the cigarette packs. A suitable adhesive is applied to the folded inserts at station 66 and the inserts with adhesive thereon are then applied directly to the flexible outer wrap material 62. The outer wrap material with the folded insert thereon is ultimately delivered to and placed around cigarette packs 14, as is well known. Placement of the flexible outer wrap material is such that the folded inserts are positioned between the cigarette packs 14 and the outer wrap material.

The buckle folder 30 of the present invention is unique in that it comprises a plurality of rollers 38, 40, 42, 48 and 52, all of which have horizontal axes of rotation generally parallel to one another. Also, the rollers are secured to a vertical framework 68 in cantilever fashion so as to provide an outer open side opposite the points of roller connection to framework 68. This roller arrangement provides a self clearing characteristic whereby folded inserts that become misaligned during high speed folding processes simply exit the open outer side of the rollers.

Figure 4:
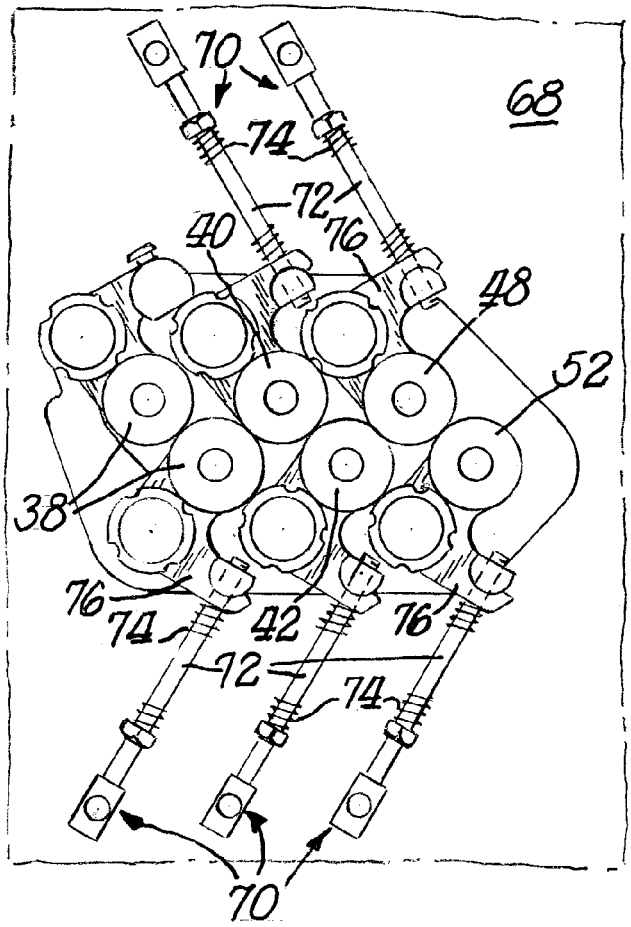
FIG. 4 is a side elevational view of the open side of the buckle folder of the systems shown in FIGS. 1 and 2.
Figure 5:
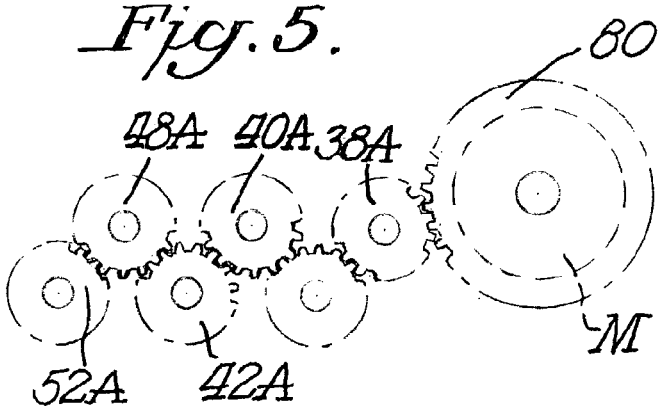
FIG. 5 is a partial side elevational view of the drive train for the individual cantilever rollers of the buckle folder, according to the present invention.
Figure 6:
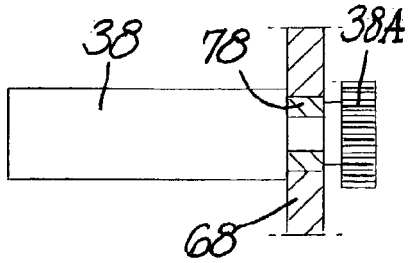
FIG. 6 is a partial front elevational view illustrating one of the cantilever rollers and its associated gear, according to the present invention.

FIGS. 4, 5 and 6 illustrate further details of the buckle folder 30, particularly the mounting structure for the cantilever rollers and the drive gears for the rollers.

As shown best in FIG. 4, the cantilever rollers 38, 40, 42, 48 and 52 are adjustably tensioned by tension applicators 70. More tension is applied to the roller nips by tightening threaded elements 72 which thereby compresses coil springs 74 and applies more tension to the roller nips via the bracket 76.

FIGS. 5 and 6 illustrate the cantilever connection of the rollers to support plate 68, and the gear drive for the rollers. Bushings 78 are provided between the rollers and plate 68. Each roller includes a gear 38A, 40A, 42A, 48A and 52A at the inside end thereof, and these gears intermesh with one another so that the rollers rotate in the proper direction and at the same rotational speed. A motor driven gear 80 meshes with gear 38A to drive the rollers of the buckle folder.

Moreover, cutter assembly 18, transport 28, buckle folder 30 and applicators 54, 64 may be driven in synchronous fashion to apply the inserts directly onto packs of cigarettes before being wrapped or onto the outer wrap before placement around the packs. Additionally, there may be some accumulation of the cut inserts and/or folded inserts before the application process.

The present invention also includes a method of folding preprinted inserts and applying such inserts to consumer packs such as cigarette packs 14. The essential method steps include providing a continuous roll 16 of preprinted inserts and cutting individual inserts from the roll. The individual inserts are then serially conveyed in a downstream direction and each insert is folded along at least one fold line. The final step in the overall method is applying the folded inserts to the cigarette pack either directly or to the flexible outer wrap 62 before that wrap is placed around the cigarette pack.

The present invention may be used in combination with a GD 4350 wrapping machine or any other wrapping mechanism. For example, the Focke 750 wrapping machine includes dual paths for the flexible outer wrap material. When the present invention is used with the Focke 750 wrapper, the continuous roll of preprinted inserts may include two lines of inserts in side-by-side relation. Prior to being cut into individual inserts, the roll may be longitudinally slit and dual transport paths with dual buckle folders and applicators may be provided for placement of the folded inserts onto dual streams of cigarette packs or dual paths of flexible outer wrap material.

The present invention may also be used in a system where the folded inserts are accumulated prior to application to the cigarette packs. Such accumulation may be in stacks or in fan-like or shingle fashion where the folded inserts are placed next to one another in partially over lapping relationship.

Any adhesive may be used to fasten the folded inserts directly to the cigarette packs or the flexible over wrap material. Hot melt and heat activated adhesive are a few examples.

Although the buckle folder described above functions to produce a four panel, three fold line insert, other arrangements are also possible by modifying the rollers of the folder. For example, by removing the last chute 50 and roller 52, a three panel, two fold line insert may be produced.

We claim:

1. An in-line insert folder system comprising:

a continuous roll of preprinted inserts;

a cutter constructed and arranged to cut individual inserts from the roll;

a transport for serially conveying the individual inserts in a downstream direction;

a buckle folder constructed and arranged to receive each individual insert and fold each insert along at least one fold line; and an applicator for serially receiving the folded inserts from the buckle folder and applying the folded inserts to consumer packs, wherein said cutter, said transport, said buckle folder and said applicator are driven synchronously to apply the preprinted inserts directly onto consumer packs before being wrapped or onto a flexible outer wrap material before placement around the packs, said buckle folder and said applicator mutually arranged such that upon exiting said buckle folder, each folded insert is delivered directly to the applicator without an accumulation of folded inserts, said folded inserts remaining spaced apart between said buckle folder and said applicator.

2. An in-line insert folder system as in claim 1 wherein the buckle folder includes a plurality of rollers having horizontal axes of rotation generally parallel to one another and secured to a vertical framework in cantilever fashion.

3. An in-line insert folder system as in claim 2 including a stream of spaced apart consumer packs, and wherein the applicator applies the inserts directly onto the packs.

4. An in-line insert folder system as in claim 2 including a continuous supply of flexible outer wrap material for consumer packs, and wherein the applicator applies the folded inserts directly onto the outer wrap material prior to consumer packs being wrapped with the outer wrap material.

5. An in-line insert folder system as in claim 2 including an adhesive applicator for applying adhesive to the folded inserts prior to applying the inserts to consumer packs.

6. An in-line insert folder system as in claim 2 wherein the rollers are cantilevered so as to provide an outer open side opposite the framework to allow misaligned inserts to exit from the outer open side of the buckle folder.

7. An in-line insert folder system as in claim 1 wherein the buckle folder includes cantilevered rollers having an open side to allow misaligned inserts to exit from the buckle folder.

8. A method of folding preprinted inserts and applying folded inserts to consumer packs comprising the steps of:

(a) providing a continuous roll of preprinted inserts;

(b) cutting individual inserts from the roll;

(c) serially conveying the individual inserts in a downstream direction;

(d) folding each individual insert along at least one fold line; and (e) applying the folded inserts to consumer packs, wherein steps (a)-(e) are conducted synchronously to apply the preprinted inserts directly onto consumer packs before being wrapped or onto a flexible outer wrap material before placement around the packs, said inserts being folded and applied without an accumulation of folded inserts, said inserts remaining spaced apart between said folding and said applying.

9. A method as in claim 8 further including the step of:

conveying a stream of spaced apart consumer packs, and wherein the folded inserts are directly applied onto the consumer packs.

10. A method as in claim 8 further including the step of:

providing a continuous supply of flexible outer wrap material for consumer packs, and wherein the folded inserts are directly applied onto the flexible outer wrap material prior to consumer packs being wrapped with the outer wrap material.

11. A method as in claim 8 further including the step of:

applying adhesive to the folded inserts prior to applying the folded inserts to consumer packs.

12. A method as in claim 8 further including the step of: self clearing any misaligned folded inserts through a side opening during folding of the individual inserts.

13. A method of including a folded element with a package during mass production of the package, said method comprising the steps of:

(a) repetitively establishing a package during mass production;

(b) directing said package through an automated wrapper; dispensing the element in an unfolded, continuous condition;

(c) repetitively cutting the unfolded, continuous element so as to create individual elements in an unfolded condition;

(d) thereafter buckle folding each cut, individual element along at least one fold line; and (e) repetitively applying each cut and folded individual element to a package component in coordination with said step of directing said package through said automated wrapper, wherein steps (a)-(e) are conducted synchronously to apply each cut and folded individual element directly onto the package component before being wrapped or onto a wrapping material before placement around the partially completed package, said inserts being folded and applied without an accumulation of folded inserts, said inserts remaining spaced apart between said folding and said applying.

14. A method as in claim 13 further including the step of: self clearing any misaligned element through a side opening during folding of the individual elements.

* * * * *